United States Patent [19]

Cole

[11] 3,979,982

[45] Sept. 14, 1976

[54] APPARATUS FOR SLICING AND DISPENSING JELLIED FOOD PRODUCTS FROM CANS AND COLLECTING THE DISPENSED SLICES

[76] Inventor: Lawrence S. Cole, High St., North Carver, Mass. 02355

[22] Filed: Sept. 23, 1974

[21] Appl. No.: 508,144

[52] U.S. Cl. ..... 83/150; 83/167; 83/402; 83/437; 83/467 R; 83/607; 83/660

[51] Int. Cl.[2] ..... B26D 4/38

[58] Field of Search ..... 83/150, 167, 401, 402, 83/437, 467, 468, 607–609, 701, 212.1, 660; 30/16

[56] References Cited

UNITED STATES PATENTS

| | | | |
|---|---|---|---|
| 1,115,697 | 11/1914 | Loga | 83/437 |
| 1,783,222 | 12/1930 | Collins et al. | 83/467 |
| 1,818,244 | 8/1931 | Folk | 83/161 X |
| 1,931,982 | 10/1933 | Faillers | 83/212.1 |
| 2,101,755 | 12/1937 | Rosenstone et al. | 83/437 X |
| 3,774,487 | 11/1973 | Topliffe | 83/437 X |

*Primary Examiner*—J. M. Meister

[57] ABSTRACT

Dispensing apparatus has a holder supporting an opened can of a jellied food product with its open end downwardly disposed and spaced from a stop that limits the extent to which the body of the jellied food product protrudes from the can. A blade is operable to sever a slice from the protruding end of the jellied food product and means are provided to ensure the discharge of the slices onto a receiver having means for collecting juices escaping from the can. Means are also provided to puncture the closed end of the can while supported by the holder and to provide an air assist to cause the jelly body to slide towards the stop.

20 Claims, 9 Drawing Figures

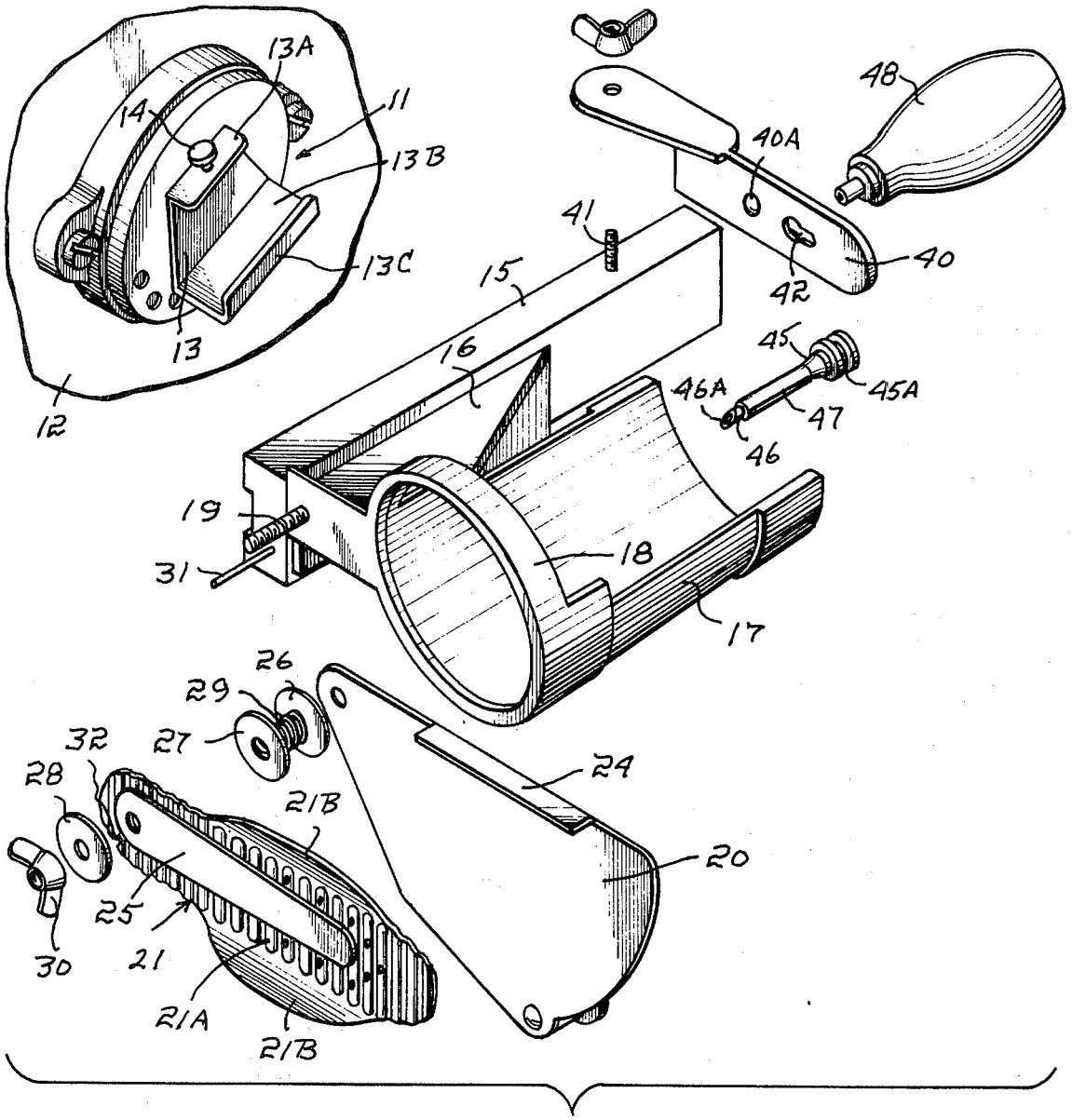
FIG. 6
FIG. 7
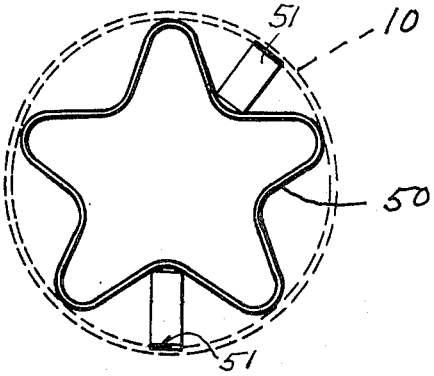
FIG. 8
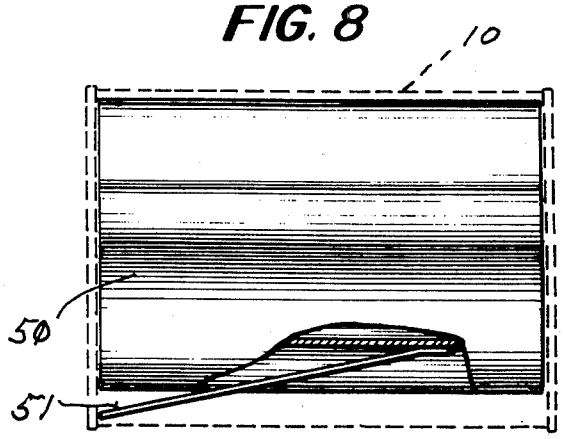

APPARATUS FOR SLICING AND DISPENSING JELLIED FOOD PRODUCTS FROM CANS AND COLLECTING THE DISPENSED SLICES

BACKGROUND REFERENCES U.S. Pat. Nos. 1,217,953, 1,616,836, 2,603,868, 2,810,195.

BACKGROUND OF THE INVENTION

While the invention is herein discussed with particular reference to cranberry sauce, it is equally well adapted for use in slicing and dispensing other canned jellied food products.

Canned cranberry sauce is commonly sliced into servings after the contents have been removed as a cylindrical body from the can. This procedure does not ensure uniformity in the servings as to thickness and shape. There is, in addition, the problem of juice for while the volume of liquid free in the cans varies, it has value as a flavorsome drink or ingredient thereof but presently it is a nuisance to collect and is, therefore usually wasted.

THE PRESENT INVENTION

The general objective of the present invention is to provide apparatus for slicing and dispensing jellied food products from cans in servings of substantially uniform thickness and for simultaneously collecting the slices on a receiver and the juices in a container.

In accordance with the invention, this objective is attained with apparatus that holds an opened can with its open end downwardly disposed and spaced from a stop engageable by the proximate end of the jellied body as it slides forwardly. A blade is movable between the first position in which the path of the jellied body is not blocked and a position in which the exposed end of the body is sliced free and the path is blocked and the blade includes means operable to dislodge a slice from the stop without unblocking the path.

Another objective of the invention is to ensure that the jellied body will slide forwardly, an objective attained by providing means to so open the other end of the can that a force may be exerted against the jellied body. Desirably, the means consist of a puncturing element in the form of a cannula and by forcing air into the can through the cannula as by means of a squeeze bulb the jellied body is forced to slide forwardly.

Another objective of the invention is to provide apparatus in which the slices are dispensed by gravity above a receiver, an objective attained by providing that their transfer thereto is along a path that is downwardly inclined at an acute angle towards the receiver, preferably with the apparatus holding the can in an inclined position and with the stop in a plane at right angles to the axis of the can.

Another objective of the invention is to minimize adhesion between the stop and the slice, an objective attained with a perforated stop having corrugations that are downwardly inclined.

Yet another objective of the invention is to provide a receiver for the slices that also enables the juice escaping from the can or the slices to be simultaneously collected, an objective attained with a movable receiver for the slices and having a drain in communication with a juice container.

Another objective of the invention is to provide servings of different sizes and shapes, an objective met by providing die inserts that may be forced into the jellied product through the open end of the can and through which the jellied body must pass as it slides forwardly thereby to be severed lengthwise into sections of a desired cross sectional shape or shapes.

BRIEF DESCRIPTION OF THE DRAWINGS

A preferred embodiment of the invention is illustrated by the drawings and

FIG. 6 is an exploded view showing the principal parts in perspective;

FIG. 7 is an end view of a die insert dimensioned to be forced into the jellied body through the open end of the can to cause the body to be longitudinally sectioned;

FIG. 8 is a partly sectioned side view of the insert; and

THE PREFERRED EMBODIMENT OF THE INVENTION

Apparatus for slicing and dispensing a jellied food product from a can 10 includes a mount, generally indicated at 11 and shown as secured to a wall 12 and provided with a laterally opening channel 13 formed with an overlying flange 13A through which is threaded a set screw 14 and an underlying flange 13B, the outer edge 13C of which is upwardly disposed.

Figure 1:
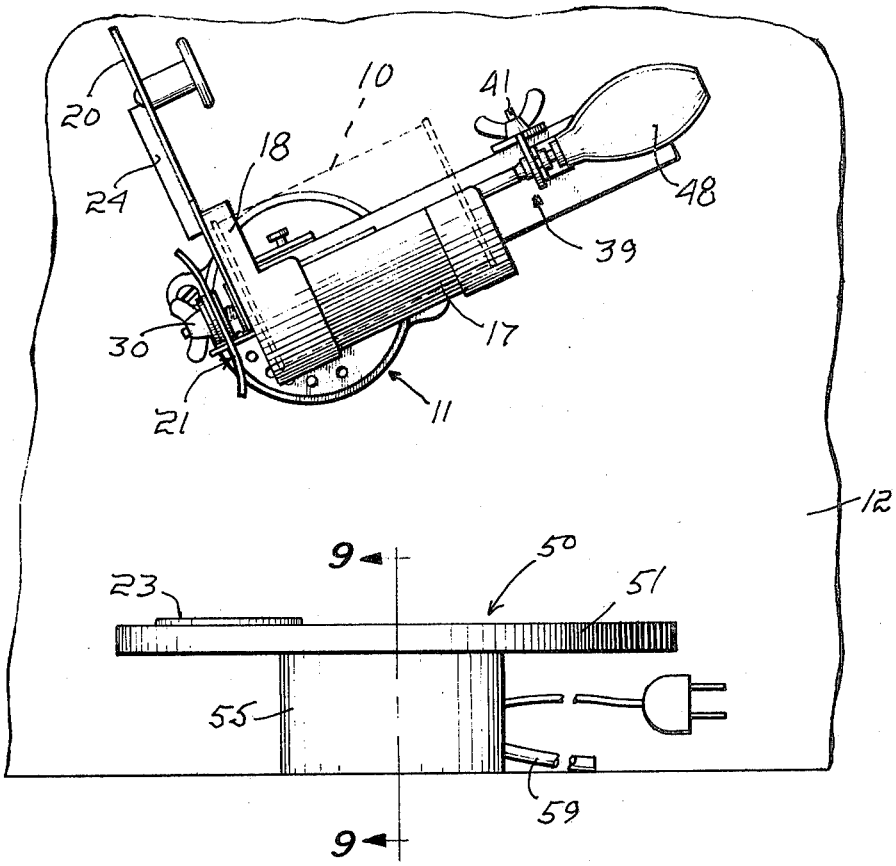
FIG. 1 is a side elevation of both the apparatus and the receiver.

A supporting member 15 is a slidable fit in the channel 13 and is detachably secured therein by the set screw 14. The supporting member 15 has a bracket 16 to which an arcuate can holder 17 is secured, the can holder 17 provided at its forward end with an annular socket 18 receiving and confining the open end of the can 10 as, in use, the cans are held with their open ends downwardly disposed. The bracket 16 also is provided with a pivot 19 for a blade 20 and the pivot 19 also serves to support a stop 21 in a plane at right angles to the can axis and spaced from the open end of the can to limit the extent to which the body 22 of the jellied food product can protrude from the can 10. The blade 20 is in a parallel plane close to the open can end with the space between it and the stop 21 determining the thickness of the slice 23 cut from the body 22 when the blade is swung forwardly and downwardly from its upper inoperative position shown in FIG. 1 in which the path of the body 22 emerging from the can 10 is not blocked into a position in which the slice 23 is cut therefrom. The blade 20 is shaped and dimensioned so that after the cutting edge 20A has passed through the jellied body 22, its flange or shoulder 24 extending lengthwise of the back of the blade 20 and disposed towards the stop 21 will engage the slice, if it adheres to the stop 21, and dislodge it therefrom, usually before the blade 20 reached the position shown in FIG. 3 in which the blade still blocks the escape of the jellied body 22 from the can 10.

Figure 3:
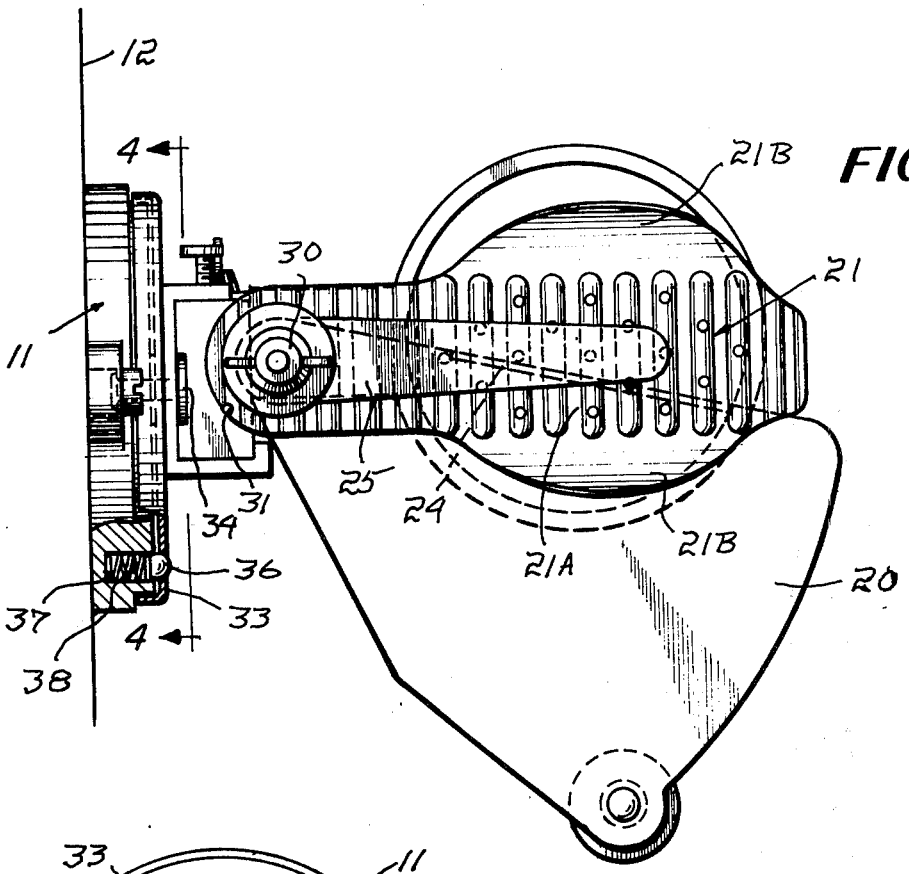
FIG. 3 is a front view of the apparatus after a slice of the jellied product has been dispensed.

In order to minimize the tendency of the slice 23 to adhere to the stop 21, the stop 21 is a smooth surface plastic strip the central portion 21A of which is vertically corrugated and perforated and extends transversely centrally of the major portion of the path of the body 22 as will be apparent from FIG. 3 and with its upper and lower margins 21B curved slightly away from the blade 20. As such a stop 21 is shown as relatively thin and, accordingly, flexible, it is shown as backed by a brace 25 also secured by the pivot 19.

The pivot 19, as may best be seen in FIG. 3, is threaded and passes freely through bores in the blade 20, the stop 21 and its brace 25 and through washers 26, 27 and 28. A compression spring 29 is confined between the washers 26 and 27 and these are located between the blade 20 and the stop 21 while the washer 28 is between the brace 25 and a wing nut 30 threaded on the pivot 19 to hold the blade and stop in place and to so compress the spring 29 as to provide friction holding the blade 20 from moving unless manually operated. While the spacing between the blade 20 and the stop 21 may be otherwise effected, the disclosed arrangement permits the thickness of a slice to be varied simply by turning the wing nut 30 in one direction or the other to the desired extent. It will be noted that the stop 21 is held against turning by means of an anchor pin 31 fixed in the proximate end of the supporting member 15 and extending through a notch 32 in the stop 21.

Figure 4:
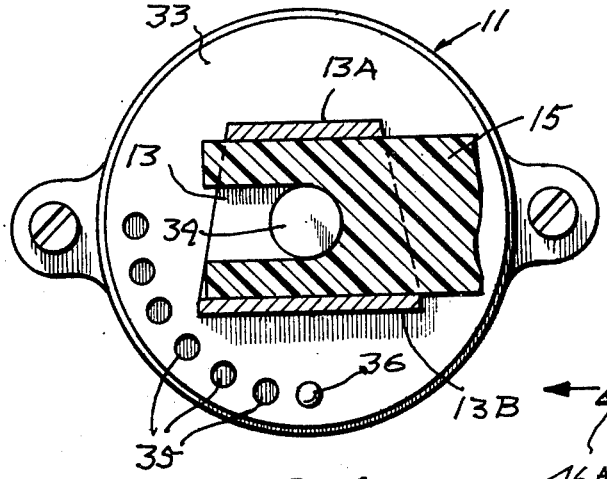
FIG. 4 is a fragmentary section taken approximately along the indicated line 4—4 of FIG. 3.

In the operation of the apparatus, it is preferred that the opened can 10 be held in a downwardly inclined position. For that reason, the mount 11 has, see FIGS. 3 and 4, a disc 33 axially connected thereto by a pivot 34 and the channel 13 is centrally mounted on the disc 33 which has a series of holes 35 arranged arcuately with respect to the pivot 34. The disc 33 is held against turning by means of a detent shown as consisting of a ball 36 partially seated in a bore 37 in the mount 11 and backed by a compression spring 38 bottomed therein so that the ball 36 is forced outwardly to partially enter first one and then another of the holes 35 as the disc 33 is turned in one direction or the other. By these or other means, the desired angle between the axis of the held can 10 to the horizontal that ensures the best operation can be readily established.

In practice, a can 10 has its cover removed and is then quickly placed in the can holder 17, open end downwardly. Usually, the jellied body 22 does not slide forwardly because its other end is closed and the opening of said other end before the can 10 is placed in the holder 17 results in the escape of juice.

Figure 2:
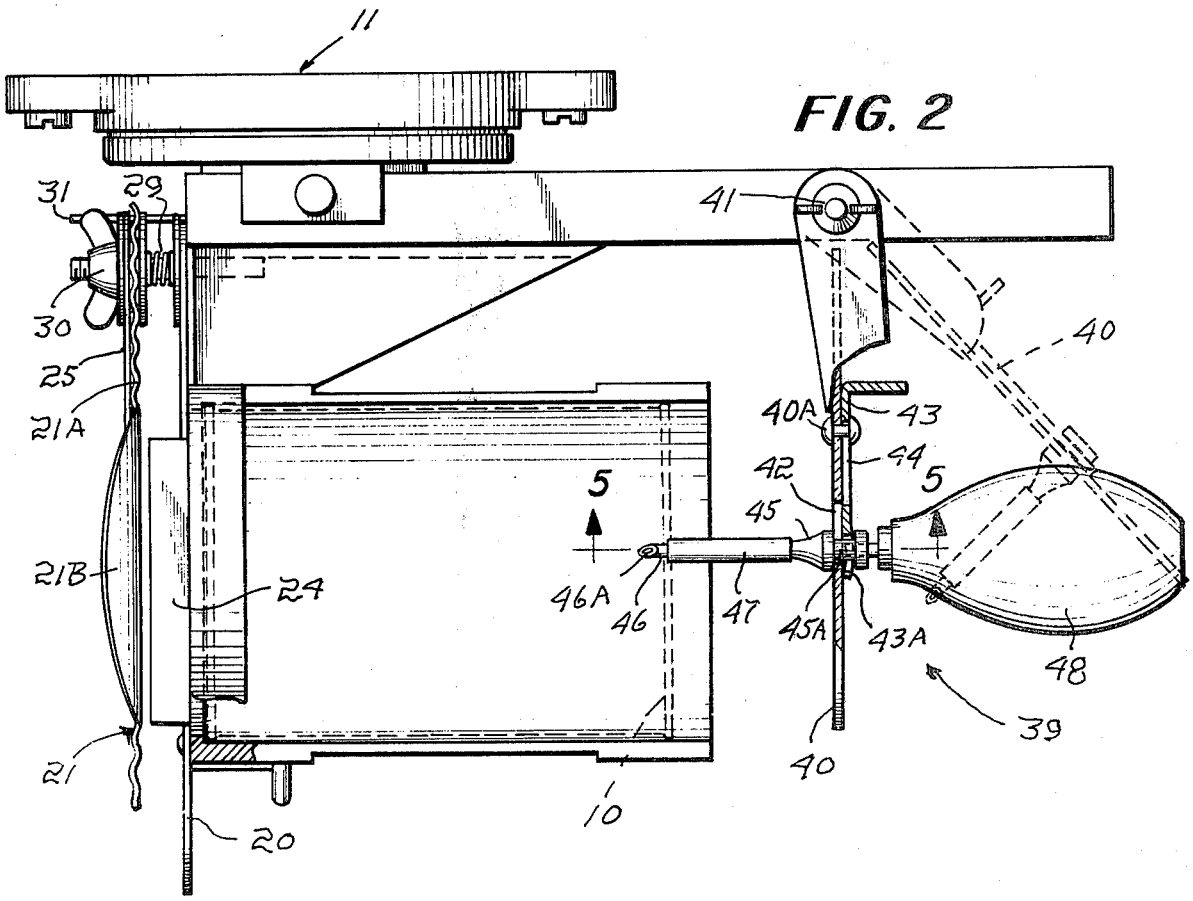
FIG. 2 is a partly sectioned plan view of the apparatus on an increase in scale.
Figure 5:
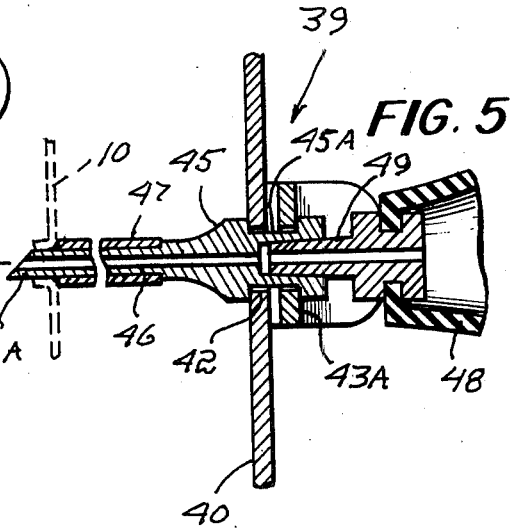
FIG. 5 is a section, on an increase in scale taken approximately along the indicated line 5—5 of FIG. 2.

For that reason, the apparatus is provided with can piercing means, generally indicated at 39 and best seen in FIGS. 2, 5, and 6. The can piercing means 39 has an arm 40 pivotally connected as at 41 to the supporting member 15 in a manner permitting it to swing between an operative position at right angles thereto and a position in which a can 10 may be placed in or removed from the holder 17.

The arm 40 has a keyhole slot 42 extending lengthwise thereof in a position such that its smaller end is located centrally of the proximate end of the can 10 when in its operative position. A holder 43 is shown as slidably connected to the arm 40 by means of a rivet 40A passing through a slot 44 in the holder 43 and has a spring fork 43A at one end disposed and dimensioned to straddle the annular groove 45A in the hub 45 of a cannula 46 provided with a bevelled, can-piercing tip 46A. The larger end of the keyhole slot 42 is dimensioned to enable the hub 45 to be entered therein and then slid into the smaller end thereof, then to be secured by advancing the holder 43 until its spring fork 43A is wedged against the arm 40 and one wall of the groove 44. A sealing sleeve 47 is a friction fit on the cannula 46.

With this arrangement, the arm 40 may be swung towards the can 10 until its closed end is penetrated by the cannula tip 46A with the sealing sleeve 47 butted against the can end. Should the jellied body 22 then fail to slide forwardly and downwardly against the stop 21, air pressure may be employed to ensure such necessary movement of the jellied body 22 by means of the actuation of a squeeze bulb 48 having a tip 49 dimensioned to frictionally fit the hub 45.

Figure 9:
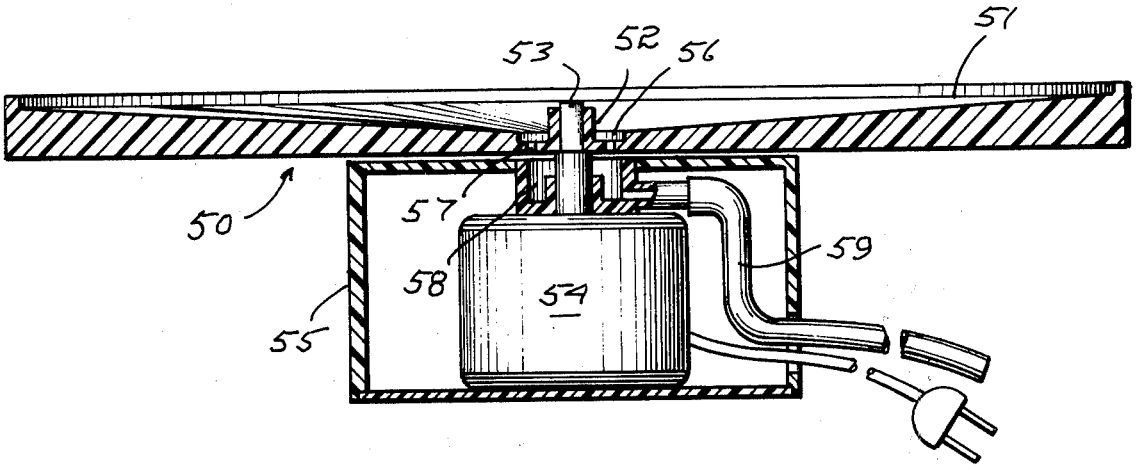
FIG. 9 is a section taken through the receiver on an increase in scale and substantially along the line 9—9 of FIG. 1.

A receiver, generally indicated at 50, is located below the open end of the can 10 to receive the dispensed slices and the spacing between the dispenser and the receiver may be varied by releasing the set screw 14 and sliding the downwardly inclined supporting member 15 in one direction or the other to the required extent relative to the channel 13 and again tightening the set screw 14. The receiver 50 is shown, see FIGS. 1 and 9, as including a dish 51 having a hub 52 connected to the vertical drive shaft 53 of a motor 54 within a housing 55, the drive being desirably at the rate of about 1 RPM and the dish 51 is dimensioned to receive all the slices of a one pound can.

It will be appreciated that each can may contain a considerable volume of juice and for that reason, the dish 51 has an axial well 56 provided with ports 57 permitting the escape of juice from the rotating dish into a well 58 surrounding the motor shaft 53 and a conduit 59 is connected to the well 58 to enable the juice to be discharged into a container, not shown.

From the foregoing it will be appreciated that apparatus in accordance with the invention is well adapted to meet the requirements of quickly and easily preparing attractive servings of canned jellied products.

If desired, a die insert such as that generally indicated at 50 in FIGS. 7 and 8 may be used. Such an insert is forced into the jellied body 22 through the open end of the can 10 and as the jellied body 22 slides forwardly therein it is divided into lengthwise sections so that when the jellied body is sliced, the slices are of different sizes and shapes. In practice, each insert 50 is provided with at least one resilient arm 51 disposed to catch against the bead left within the can 10 when its cover was removed.

I claim:

1. Apparatus for dispensing jellied products from a can in substantially uniform servings, said apparatus comprising a support, a holder for a can that has been opened at one end, said holder secured to said support and operable to hold that can in an inclined position, open end downwardly disposed, a stop, means connecting said stop to said support with the stop spaced from the open end of the can in a position to be engaged by the exposed end of the jellied body as it slides forwardly relative to the can, and a cutter connected to said support and movable across the open end of the can between it and the stop between a first position in which the path of the sliding jelly body is not blocked into a position in which said path is blocked and the exposed end of the body is sliced free, said stop connecting means disposed to provide between the stop and the open end of the can, a downwardly opening passageway for slices.

2. The apparatus of claim 1 and a die insert in the open end of the can and disposed transversely thereof, said insert of a size and shape dividing the jellied body lengthwise into sections of predetermined shapes as it is entered into the can through the open end and as the jellied body slides towards the stop, the insert includes portions engaging the wall of the can and at least one resilient arm disposed with its free end disposed towards the open end of the can and engageable with the internal bead left therein when the can was opened.

3. The apparatus of claim 2 in which the insert includes resilient arms engaging the wall of the can and disposed with their free ends disposed towards the open end of the can and engageable with the internal bead left therein when the can was opened.

4. The apparatus of claim 1 and means connected to said support and including a can puncturing element located adjacent the other end of the can and movable into and out of a can-puncturing position.

5. The apparatus of claim 4 in which the can-puncturing means includes an arm to which the element is attached, said arm hingedly connected to the support to swing towards and away from said other can end.

6. The apparatus of claim 5 in which the can-puncturing element is a cannula provided with a can-puncturing tip.

7. The apparatus of claim 6 and a squeeze bulb secured to the other end of the cannula and operable to create air pressure within said can operable at least to initiate the sliding of the jellied body towards the open end of the can.

8. The apparatus of claim 1 and means operable to create air pressure within the other end of the can through a hole punched in the other end of the can, the air pressure operable at least to initiate the sliding of the jellied body towards the stop.

9. The apparatus of claim 8 in which the means creating air pressure in the can includes a tubular member extending through the hole in said other can end, and a squeeze bulb connected to the tubular member.

10. The apparatus of claim 1 in which the cutter includes a shoulder disposed towards the stop and so spaced from the cutting edge that it cannot engage the body until the cutting edge has passed through the body.

11. The apparatus of claim 1 in which the stop is disposed in a plane substantially at right angles to the axis of a can positioned on the holder.

12. The apparatus of claim 11 in which the stop is perforated and corrugated with the corrugations extending in a vertical direction.

13. The apparatus of claim 1 in which the holder is arcuate and includes a seat dimensioned for engagement by the rim of the open can without blocking its open end.

14. The apparatus of claim 13 in which the seat is circular.

15. The apparatus of claim 1 and a mount, a supporting member to which the holder, the stop and the cutter are connected, the mount includes a pivotable part, the supporting member is detachably attached to the pivotable part, and means operable to lock the pivotable part to the mount against turning relative thereto.

16. The apparatus of claim 15 in which the supporting member is slidable relative to the pivotable part and means operable to secure the member to the pivotable part against such movement.

17. The apparatus of claim 1 and means below the passageway in a position to receive slices as they drop and to collect juices escaping therefrom and from the can.

18. The apparatus of claim 17 in which the receiving means is a moving support and a stationary juice collector is located below the support.

19. The apparatus of claim 17 in which the receiving means is a turntable in the form of a concave dish having an axial well and the turntable support includes a stationary well below the well of the dish, the well of the dish has ports effecting communication with the stationary well, and a container with which the stationary well is in communication, the concavity of the dish being such that slices remain outwardly of the well.

20. The apparatus of claim 1 and a moving receiver below the passageway and in the path of a slice dropping from the apparatus via the passageway, and the stop is disposed to cause each slice to drop therefrom in an inclined position with its leading portion in the direction the support is moving.

* * * * *